US006344618B1

(12) United States Patent
Sato

(10) Patent No.: US 6,344,618 B1
(45) Date of Patent: Feb. 5, 2002

(54) MULTI-DIRECTIONAL OPERATING SWITCH AND MULTI-DIRECTIONAL OPERATING DEVICE USING THE SAME

(75) Inventor: Jun Sato, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/591,936

(22) Filed: Jun. 12, 2000

(30) Foreign Application Priority Data

Jun. 10, 1999 (JP) ..... 11-163275

(51) Int. Cl.[7] ..... H01H 25/06
(52) U.S. Cl. ..... 200/6 A
(58) Field of Search ..... 200/4, 5 R, 6 A, 200/17 R, 18, 335, 339; 345/157, 161; 463/36–38

(56) References Cited

U.S. PATENT DOCUMENTS 2,808,476 A * 10/1957 Elliot ..... 200/6 A
4,428,649 A * 1/1984 Main et al. ..... 350/289
4,501,939 A * 2/1985 Hyltin et al. ..... 200/6 A
4,931,605 A 6/1990 Zoller ..... 200/408
5,889,242 A 3/1999 Ishihara et al. ..... 200/6 A
5,939,690 A 8/1999 Yasui et al. ..... 200/302.2
6,124,555 A * 9/2000 Isikawa ..... 200/4
6,160,225 A * 12/2000 Isikawa ..... 200/4

* cited by examiner

*Primary Examiner*—Michael Friedhofer
(74) *Attorney, Agent, or Firm*—Ratner & Prestia

(57) ABSTRACT

A multi-directional operating switch includes: a case made of resin having a generally square opening on top, provided on a bottom surface thereof with a central stationary contact, an outer stationary contact and peripheral stationary contacts disposed at each corner of the opening; a dome-like circular movable contact disposed in a manner to stay in contact with the outer stationary contact; a manipulation body having a flange, an upper surface and a lower surface of which are electrically conductive, placed above the dome-like circular movable contact; and a cover for covering the opening and having a shaft of the manipulation body penetrating therethrough. Switching operation is made between the central stationary contact and the outer stationary contact when the shaft is depressed, and between any adjacent two of the peripheral stationary contact and the electrically conductive cover, covering the opening of the case, when the same shaft is tilted.

20 Claims, 15 Drawing Sheets

MULTI-DIRECTIONAL OPERATING SWITCH AND MULTI-DIRECTIONAL OPERATING DEVICE USING THE SAME

FIELD OF THE INVENTION

The present invention relates to a multi-directional operating switch activated by a tilting manipulation as well as a pushing manipulation of a manipulating shaft, and used mainly in an input controller or the like of a mobile communications apparatus such as a cellular phone, a radio pager, etc., as well as an electronic apparatus of various kinds such as a remote controller, audio equipment, a game machine, a car navigation system, an electronic camera, and the like. The invention also relates to a multi-directional operating apparatus using the same.

BACKGROUND OF THE INVENTION

A conventional multi-directional operating switch of a kind will be described hereinafter by referring to FIG. 13 through FIG. 16.

In FIG. 13 depicting a sectional front view, a box-like case 1 made of plastic resin has an opening on top surface covered by a cover 2 made of metal plate or the like.

A bottom surface of the case 1 is provided with a central stationary contact 3A, an outer stationary contact 3B and four peripheral stationary contacts 4 through 7 disposed at an equal distance from the central stationary contact 3A in directions toward right, left, back and front side, all fixed by insertion formation as shown in FIG. 14 of an exploded perspective view with a case cut away partially. These contacts are connected individually to their respective terminals 14A, 14B, and 15 through 18. A dome-like circular movable contact 8 is placed on the outer stationary contact 3B. A congregated movable contact 9 is fixed by pillars 1A above the peripheral stationary contacts 4 through 7 in such a manner that flexible contact leaves 10 through 13 of the congregated movable contact 9 face their respective peripheral stationary contacts 4 through 7. The congregated movable contact 9 is connected to a terminal 19A for external connection via a contact 19.

A supporting body 21 is positioned above the congregated movable contact 9, and a square-shaped upper end 21A of the supporting body 21 maintains a resilient contact with an underside surface of the cover 2, as it is biased upwardly by a compression coil spring 20 disposed besides an inner periphery along side walls of the case 1. A recess portion 21B in a center of the supporting body 21 holds a semi-spherical rotating body 22.

The rotating body 22 is in its position where a flange portion 22A at its lower perimeter rests on a bottom surface of the recess portion 21B in the center of the supporting body 21, and an upper spherical portion 22B fits in contact with a spherical surface of a circular hole 2A in a center of the cover 2. A rod-like manipulating shaft 23 made of metal is inserted and held in a vertical center hole 22C of a noncircular shape in the rotating body 22 in a manner of sliding vertically.

The manipulating shaft 23 has a lower end 23A projecting downwardly from the rotating body 22, so as to rest in contact with the dome-like circular movable contact 8 in a center of the bottom surface of the case 1. A manipulation knob 24 is mounted on a tip end 23B of the manipulating shaft 23 projecting upwardly above the case 1.

A lower surface around an outer perimeter of the supporting body 21 is provided with depressing points 25A through 25D, corresponding respectively to the flexible contact leaves 10 through 13 of the congregated movable contact 9. Due to the sectional view from one side of the switch, the accompanying figure does not show the depressing points 25C and 25D corresponding to the flexible contact leaves 12 and 13.

The multi-directional operating switch operates in a manner as described hereinafter. To begin with, the manipulating shaft 23 is in its vertical neutral position, and all contacts of the multi-directional operating switch are in their open position in a state of FIG. 13, wherein the lower end 23A of the manipulating shaft 23 does not depress the dome-like circular movable contact 8.

When a left upper surface of the manipulation knob 24 mounted on the tip end 23B at an upper part of the manipulating shaft 23 is depressed downward, the manipulating shaft 23 tilts and the rotating body 22 rotates toward the left side while keeping in contact with the spherical surface of the circular hole 2A of the cover 2, as shown by an arrow in FIG. 15 of a section front view. This causes an edge of the flange portion 22A on the underside of the rotating body 22 to push the bottom surface of the recess portion 21B of the supporting body 21 downward, and to tilt the supporting body 21 toward left with a fulcrum being at an upper edge 21A at a side of the square form opposite to the surface being pushed. The supporting body 21 then pushes down the flexible contact leaf 10 corresponding to the depressing point 25A, thereby making it to contact with the peripheral stationary contact 4. This establishes an electrical continuity between the congregated movable contact 9 and the peripheral stationary contact 4, and completes a closed circuit through the terminals 19A and 15 for external connection. During this movement, a left side of the upper edge 21A in the perimeter of the supporting body 21 separates from the underside surface of the cover 2 while depressing the compression coil spring 20 downward.

When the depressing force applied to the manipulation knob 24 is removed afterwards, a restoring force of the compression coil spring 20 pushes back the supporting body 21 and the rotating body 22 to their original neutral positions shown in FIG. 13. At the same time, the restoring force also returns the flexible contact leaf 10 to the original position shown in FIG. 13 by separating it from the peripheral stationary contact 4, thereby turning off the switch contact.

Likewise, a closed circuit can be established through any of the terminals 16 to 18 for external connection by changing a position to be depressed among a right side, a front side and a back side on the upper surface of the operating knob 24 mounted on the manipulating shaft 23.

When a center upper surface of the operating knob 24, i.e. the manipulating shaft 23, is pushed downward by placing a vertical depressing force from the above, as shown by an arrow in a sectioned front view of FIG. 16, the lower end 23A pushes the dome-like circular movable contact 8 on the bottom surface of the case 1, causing it to distort. This produces a tactile response, and establishes a closed circuit through the terminals 14A and 14B by making continuity between the central stationary contact 3A and the outer stationary contact 3B. The manipulating shaft 23 is pushed up by a restoring force of the dome-like circular movable contact 8, and returned to its original position of FIG. 13, when the depressing force is removed.

In spite of a growing demand for downsizing of a variety of the latest electronic apparatuses, however, a reduction in overall size and thickness of the conventional multi-directional operating switch of the type described above has been difficult to attain due to the numerous constituent components, and it has been expensive. The switch has also had a problem in that it is difficult for an operator to sensory determine when a switch contact turns on, since the switch does not produce a positive tactile response during a switching made by tilting the manipulating shaft.

The present invention is intended to solve the above problem of the prior art, and it aims at providing a multi-directional operating switch, which is small and thin as it requires a small number of components, yet it is capable of making a reliable switching with a tactile response even when the switching is made by tilting the manipulating shaft sideways. The invention also aims at providing a multi-directional operating apparatus using the multi-directional operating switch.

SUMMARY OF THE INVENTION

A multi-directional operating switch of the present invention includes: a case having an opening on top surface, provided on a bottom surface thereof with a central contact, an outer contact disposed away from the central contact, and a plurality of peripheral contacts; a dome-like circular movable contact having a central portion situated above the central contact, and its lower peripheral edge rests in contact with the outer contact; an electrically conductive cover having a through hole concentric to the dome-like circular movable contact; and a manipulation body including a shaft protruding through the through hole in the cover, a flange formed integrally with or fixed to a lower portion of the shaft and provided with an upper surface and a lower surface of the flange for conductively connecting between them, and a projection provided on the shaft. The flange is restricted from turning, the shaft is tiltable as well as vertically movable. At least a periphery of the flange portion stays in contact with an underside surface of the cover with a thrusting force in an upward direction by said dome-like circular movable contact. When the shaft of the manipulation body is pushed downward, the projection on the flange depresses and distorts the dome-like circular movable contact, which in turn establishes an electrical continuity between the central contact and the outer contact. When the shaft is tilted, the flange completes an electrical continuity between a certain number of the peripheral contacts and the cover.

The foregoing structure can realize the multi-directional operating switch that is small and thin, easily manipulated for reliable switching, and costs less due to a small number of constituent components, and that the switch can produce a predetermined tactile response only with the one dome-like circular movable contact disposed in the case, even when making a switching between the peripheral contacts and the electrically conductive cover by tilting the shaft of the manipulation body sideways, in addition to that when making an electrical continuity between the central contact and the outer contact by pushing the shaft of the manipulation body vertically downward.

A multi-directional operating switch of the present invention includes a case having an opening of generally square shape and provided with a peripheral stationary contact disposed at each corner. The opening houses a flange of a manipulation body, as the flange is formed in a shape generally similar to the opening. This structure can easily prevent the flange of the manipulation body from turning within the case when the manipulation body is moved and maintain proper positions of both components with respect to each other at all the time. Consequently, the manipulating shaft can be tilted and held infallibly in a direction intermediate between predetermined adjacent two of the peripheral stationary contacts disposed at corners in the case, since the generally square-shaped flange stays still with one of its lower sides resting on a bottom surface of the case when the manipulation body is tilted. In addition, the structure makes it easy to adjust tilting angles of the shaft of the manipulation body into an equal angle, at which the peripheral stationary contacts turn into an ON state. Therefore, the invention realizes the multi-directional operating switch having small overall dimensions with a simple structure, yet the switch is capable of being switched by a tilting manipulation in the same angle toward four directions that are used frequently.

A multi-directional operating switch of the present invention is so constructed that both of an opening in a case and a flange of a manipulation body are generally rectangular of similar shape. With this structure tilting angles of a shaft of the manipulation body, at which peripheral stationary contacts turn on, can be differentiated easily between two directions orthogonal to each other by varying a proportion in length between a longitudinal side and a lateral side of the opening in the case and of the flange.

A multi-directional operating switch of the present invention includes a case having an opening of generally pentagon, hexagon, or octagon, and provided with a peripheral stationary contact at each corner of the opening. The opening houses a flange of a manipulation body, as the flange is also formed in a shape generally similar to the opening. This structure can easily prevent the flange of the manipulation body from turning within the case. It also realizes easily the multi-directional operating switch having a shaft of the manipulation body that is tiltable into a desired number of directions, since it adopts a polygonal shape having the desired number of sides for the opening and the flange.

A multi-directional operating switch of the present invention includes a case having an opening of a circular shape, and provided with peripheral stationary contacts disposed at an equal distance and an equal angle with respect to a center of the opening. The opening houses a flange of a manipulation body, as the flange is formed in a circular shape slightly smaller in diameter than the opening. The switch is provided with a turn restricting means for the manipulation body at a portion where a shaft of the manipulation body engages with a through hole in a cover, in order to maintain a position of the flange relative to the peripheral stationary contacts. This multi-directional operating switch can be manipulated in a manner that a top end of the shaft of the manipulation body moves circularly while the shaft is kept tilted, since the flange of the manipulation body has the circular shape, thereby being capable of switching smoothly a plurality of the peripheral stationary contacts disposed in the circular opening in a consecutive manner.

A multi-directional operating switch of the present invention is provided with a cover having a through hole in a shape other than circle, and a manipulation body having a shaft to be inserted in the through hole, in a cross-sectional shape other than circle. They function as a turn restricting means for the manipulation body having a circular flange. This multi-directional operating switch can reliably prevent the manipulation body from turning in a case even with a simple structure.

A multi-directional operating switch of the present invention is provided with a manipulation body constructed of an electrically conductive material. The manipulation body made of electrically conductive material makes a contact plate unnecessary, and reduces a cost of manufacturing. This structure provides the switch, wherein a tilting manipulation of the manipulation body additionally connects an outer stationary contact to a same closed circuit of two adjacent peripheral stationary contacts and a cover.

Furthermore, if the switch of the above structure is provided with a projection made of insulating material on a bottom surface of a flange, it can positively isolate a group of switching circuit among peripheral stationary contacts and a cover from another group of switching circuit between a central stationary contact and an outer stationary contact via a dome-like circular movable contact. Since a shaft and the flange of the manipulation body are integrally formed, they move solidly and reliably without shaking when making a predetermined movement of the manipulation body, thereby achieving a reliable switching of the individual stationary contacts. Moreover, a magnitude of a tactile response in the manipulation can be adjusted readily by selecting a shape and size of the projection properly.

A multi-directional operating switch of the present invention is provided with a manipulation body including an electrically conductive flange of a plate form attached to a shaft constructed of an insulating material integrally with a projection located under the flange. This structure can reduce a thickness of the multi-directional operating switch, since it reduces a thickness of the flange attached to the manipulation body.

A multi-directional operating switch of the present invention is provided with a manipulation body including a flange made of an electrically conductive material having resiliency. When a shaft of the multi-directional operating switch is tilted, an electrical continuity is established first between a peripheral stationary contact and a cover. Another electrical continuity is then established between a central stationary contact and an outer stationary contact, when a projection under the flange pushes a dome-like circular movable contact after the flange of the manipulation body deforms resiliently. This structure allows an operator to choose whether or not to make an electrical continuity between the central stationary contact and the outer stationary contact by way of varying a tilting force applied to the shaft of the manipulation body, after establishing the electrical continuity between the peripheral stationary contact and the cover. This multi-directional operating switch can be used in an electronic apparatus, for example, to change a speed of scrolling a cursor, etc. indicating a variety of items displayed on a display window and the like of the apparatus, in such a manner as to move the cursor slowly if only the peripheral stationary contact is turned on, or to move the cursor faster when the central stationary contact and the outer stationary contact are additionally turned on. In addition, this structure of the switch can avoid damages on contacts such as the peripheral stationary contacts, even if the shaft is tilted excessively due to an unintentional great force given to the manipulation body, since the flange is resilient.

As has been described, this multi-directional operating switch, when mounted in a variety of multi-directional operating apparatus, can attain a congregation and simplification of numerous manipulations as well as down-sizing, and reducing in thickness and weight at the same time.

DESCRIPTION OF THE PREFERRED EMBODIMENTS

Referring to FIG. 1 through FIG. 12, there is described hereinafter a multi-directional operating switch of preferred exemplary embodiments of the present invention, and a multi-directional operating apparatus using this switch.

First exemplary embodiment

Figure 1:
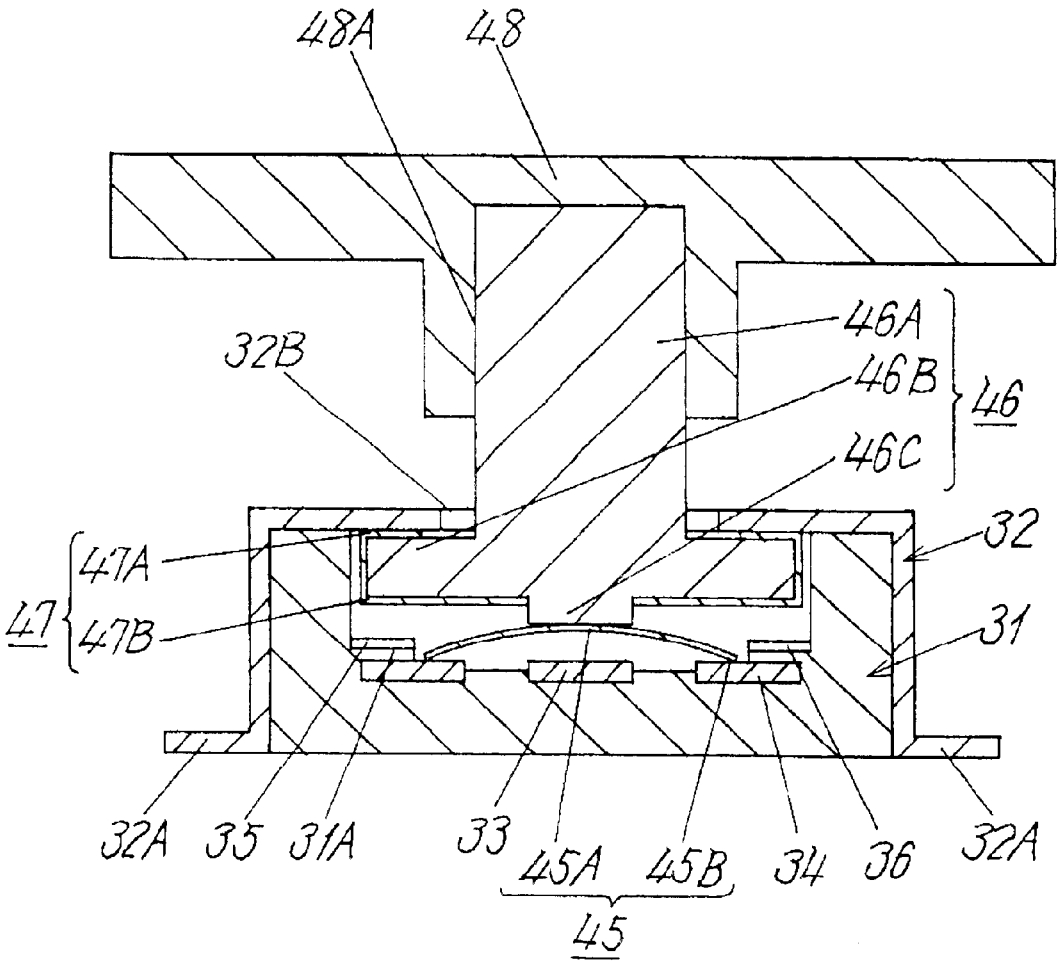
FIG. 1 is a sectional front view depicting a multi-directional operating switch of a first exemplary embodiment of the present invention.
Figure 2:
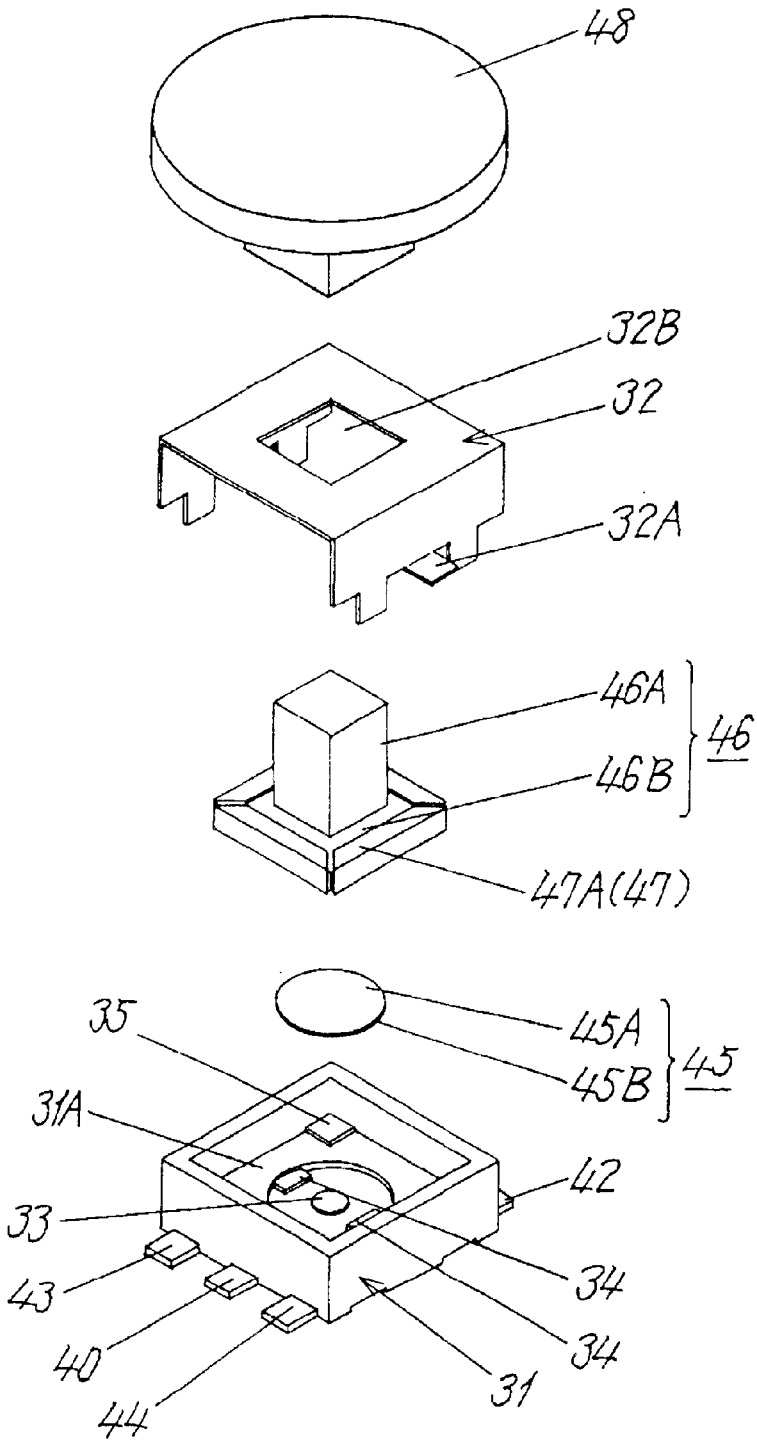
FIG. 2 is an exploded perspective view depicting the same multi-directional operating switch.

FIG. 1 is a sectional front view depicting a multi directional-operating switch of a first exemplary embodiment of the present invention, and FIG. 2 is an exploded perspective view of the same. In FIG. 1 and FIG. 2, a box-like case 31 made of molding resin is provided in its upper surface with an opening of a square shape as view from the above. This opening is covered by a cover 32 made of an electrically conductive material such as a metal plate in the same manner as that of the prior art switch. The cover 32 is provided with a terminal 32A.

Figure 3:
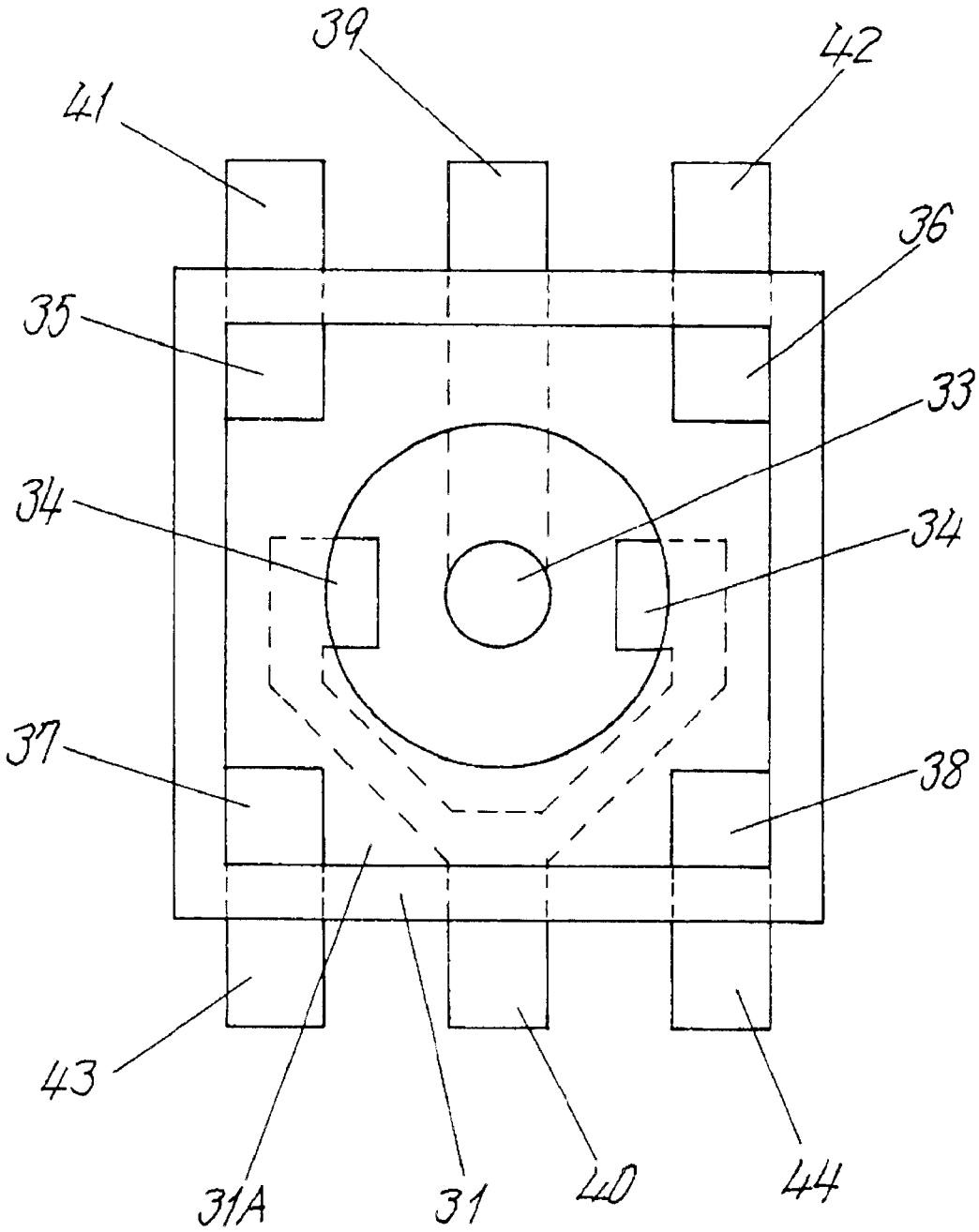
FIG. 3 is a plan view depicting a top side of a case, as an essential component of the same multi-directional operating switch.

The case 31, on its inner bottom surface, is provided with a central stationary contact 33, and an outer stationary contact 34 disposed in a position at a predetermined space apart from the central stationary contact 33, as shown in the plan view of FIG. 3. In addition, four peripheral stationary contacts 35–38 are fixed by insert molding on raised portions 31A of a predetermined height, formed at four corners of the opening in positions outside of a circular area having a radius equal to a distance between the central stationary contact 33 and the outer stationary contact 34. In other words, these peripheral stationary contacts 35–38 are disposed in the positions equally spaced from the central stationary contact 33 toward its left, right, back and front side at equal angle. Also, terminals 39–44 for external connections, respectively corresponding to the central stationary contact 33, the outer stationary contact 34, and the peripheral stationary contacts 35–38, protrude externally from the case 31.

A dome-like circular movable contact 45 made of a thin resilient metal sheet is disposed in such a manner that an underside surface of a top center portion 45A confronts the central stationary contact 33 placed on the bottom surface of the case 31, and a lower peripheral rim 45B rests directly on the outer stationary contact 34 in the case 31.

A manipulation body 46 made of insulation resin includes a shaft 46A, a square-shaped flange 46B integrally formed at a lower end of the shaft, and a projection 46C having a pushing function protruding from a lower surface of the flange 46B at a center of the shaft 46A. The projection 46C of the manipulation body 46 rests on and supported by the top center portion 45A of the dome-like circular movable contact 45. The flange 46B is housed in the case 31 with the shaft 46A protruding upwardly from the central through hole 32B in the cover 32. That is, the opening having a square shape in plan view of the case 31 houses the flange 46B, formed in a square shape of the like figure, of the manipulation body 46, thereby the manipulation body 46 maintains a proper position with respect to the case 31 without being turned in the case 31.

Figure 4:
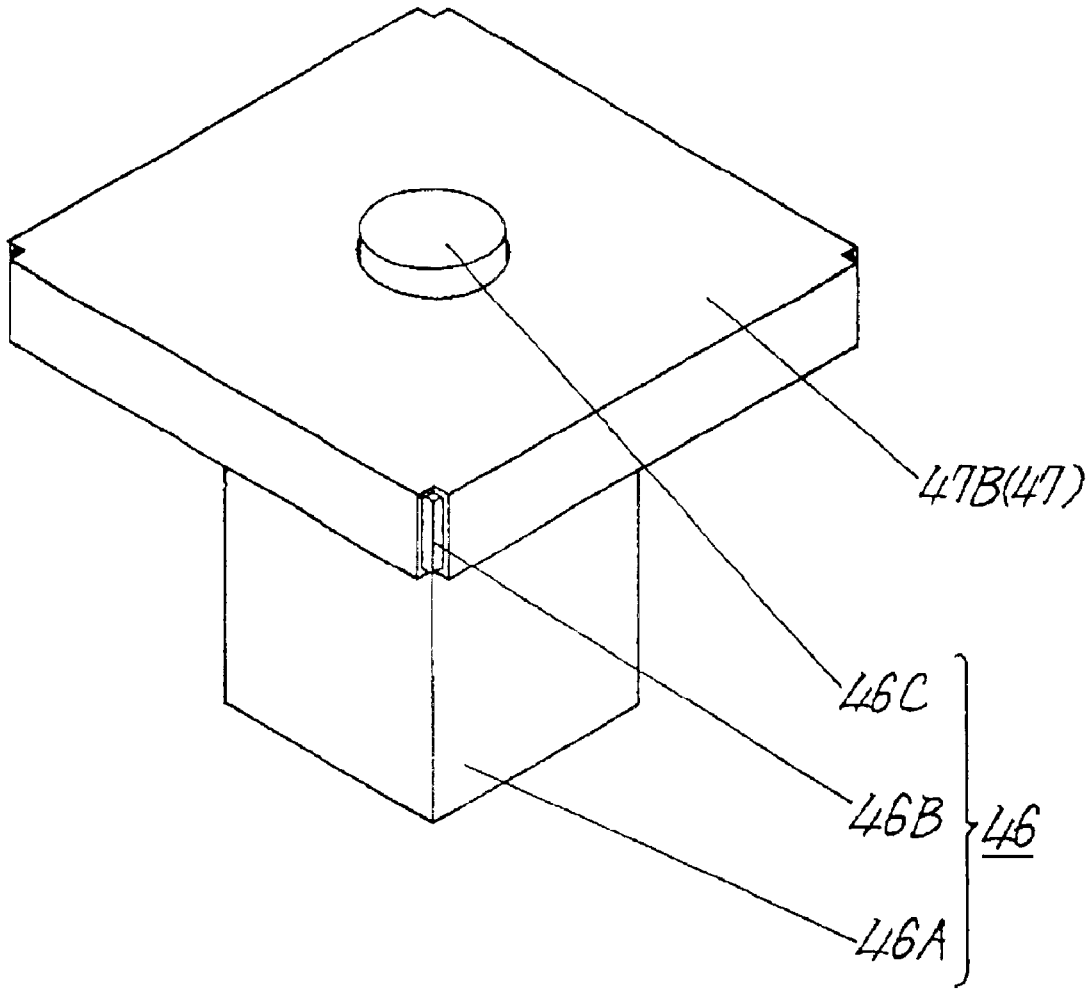
FIG. 4 is a perspective view depicting an underside of a manipulation body, as an essential component of the same multi-directional operating switch.

The flange 46B of the manipulation body 46 is fitted with a metal contact plate 47, as shown in FIG. 4 depicting a perspective view of an underside of the manipulation body, making its upper surface and lower surface to be connected conductively. The contact plate 47 is attached to the flange 46B in such a manner as to cover the lower surface, except for the projection 46C, and it is fixed in position on the upper surface of the flange 46B, by caulking it at portions that are bent upwardly along side edges of the flange 46B.

Accordingly, the contact plate 47 includes an upper conductive portion 47A covering the upper surface and a lower conductive portion 47B covering the lower surface of the flange 46B.

The manipulation body 46 is provided with a thrusting force in an upward direction by the dome-like circular movable contact 45 via the projection 46C under the flange 46B. Under a normal state in which an operating force is not applied on the shaft 46A, the thrusting force keeps the upper conductive portion 47A of the flange 46B in a position to contact with a lower surface of the cover 32, so as to also keep the shaft 46A in its neutral position. The manipulation body 46, i.e. the shaft 46A, is thereby movable to a vertical manipulation and a tilting manipulation of a predetermined way.

In addition, a manipulation knob 48 of a predetermined shape is attached to the manipulation body 46 by press-fitting a top end of the shaft 46A into a bottom hole 48A of the knob 48. An external shape of the manipulation knob 48 can be of any shape such as circle, polygon, and the like.

An operation of the multi-directional operating switch of the present exemplary embodiment will be described next.

First, in the normal state shown in FIG. 1 wherein an operating force is not applied to the shaft 46A of the manipulation body 46, all of the contacts of this switch remains in their open state, i.e. an OFF position, as the shaft 46A stays in the vertical neutral position.

Figure 5:
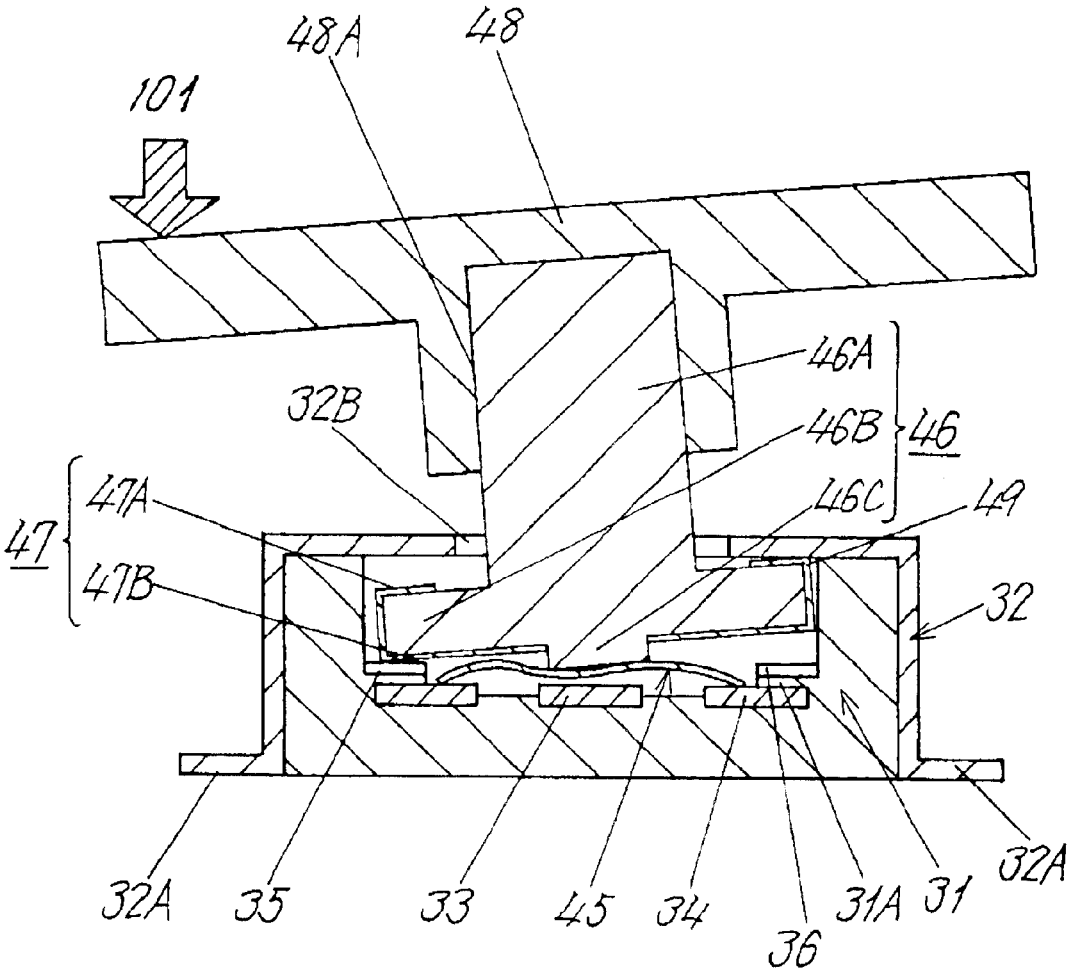
FIG. 5 is a sectional front view depicting the same multi-directional operating switch with the manipulation body in a tilted position.

When the manipulation knob 48 is depressed at a position corresponding to a midpoint between any adjacent two of the peripheral stationary contacts, 35 and 37 (FIG. 3) for example, disposed on the bottom surface of the case 31, as shown by an arrow in a sectional front view of FIG. 5, the manipulation body 46 tilts toward a left side with an upper edge 49 of the flange 46B, opposite to the position where the depressing force is applied, serving as a fulcrum. This causes the projection 46C on the lower surface of the manipulation body 46 to depress and deform the dome-like circular movable contact 45 downward, thereby yielding a tactile response, while also renders the lower conductive portion 47B of the flange 46B to contact with the peripheral stationary contacts 35 and 37 at the same time.

This establishes a closed circuit among terminals 41, 43, and 32A for external connection, since the peripheral stationary contacts 35 and 37 turn into a state of electrical continuity via the lower conductive portion 47B, at the same time they are connected electrically with the cover 32 through the upper edge 49 of the upper conductive portion 47A communicating conductively with the lower conductive portion 47B.

Since the square-shaped flange 46B of the manipulation body 46 is housed in the opening, also formed into a slightly larger square shape in plan view, provided in the case 31, the manipulation body 46 is effectively prevented from rotating, and able to reliably establish an ON state between the peripheral stationary contacts 35 and 37, i.e. the desired peripheral switch contacts, as well as between them and the cover 32.

When the depressing force applied on the manipulation knob 48 is subsequently removed, the dome-like circular movable contact 45 restores the original shape by its own resilient restoring force, and pushes back the projection 46C on the lower surface of the flange 46B of the manipulation body 46 upwardly. The lower conductive portion 47B of the flange 46B separates from the peripheral stationary contacts 35 and 37 to turn the peripheral switch contacts into an OFF state, and the manipulation body 46 resumes the normal state, wherein the shaft 46A is in an upright neutral position, as shown in FIG. 1.

When the manipulation knob 48 is depressed in the like manner at another position corresponding to a midpoint between any adjacent two of the peripheral stationary contacts, the manipulation body 46 tilts toward that direction, thereby making the corresponding peripheral switch contacts to turn on, and establishes a closed circuit between their respective adjacent two terminals among the terminals 41–44 for external connection, and the terminal 32A for the cover 32.

A signal transmitted through the closed circuit established as above is read and examined by a microcomputer (not shown in the figure), serving as a switching recognition means, connected to the terminals 41–44 and 32A for external connection, thereby the microcomputer is able to recognize that the shaft 46A is tilted toward a direction midway between the above-said adjacent two of the peripheral switch contacts.

If the manipulation knob 48 is depressed in a position closer to the peripheral stationary contact 35 due to an inadvertent deviation from where the depressing manipulation is sought, in an attempt to turn ON the peripheral stationary contacts 35 and 37, the manipulation body 46 tilts toward that direction, and renders the lower surface at a corresponding corner of the flange 46B to be in contact with the peripheral stationary contact 35 first. However, the flange 46B, as it is formed in the external shape of square, shifts along a side of the bottom surface contiguous to the corner toward the midway between the peripheral stationary contacts 35 and 37, and stays in that position to eventually establish a closed circuit among the peripheral stationary contacts 35 and 37 and the cover 32.

It is difficult to turn any combination of the two adjacent peripheral stationary contacts into an ON state simultaneously at all the time without a time delay, since a position being depressed on the manipulation knob 48 changes from time to time in the actual use condition. Therefore, it is preferable to cope with this problem by a software program for a time the reading is taken by a microcomputer (not shown), serving as a switching recognition means, and the like, in such a manner that the microcomputer disregards a signal transmitted through the closed circuit established first with the peripheral stationary contact 35 alone.

In addition, there is an occasion wherein another signal is transmitted externally through the terminals 39 and 40 for external connection, if the dome-like circular movable contact 45 comes in contact with the central stationary contact 33, thus making a continuity between the central stationary contact 33 and the outer stationary contact 34, when the dome-like circular movable contact 45 deforms downward during the tilting manipulation. This signal shall also be disregarded by the microcomputer (not shown) and the like, so that it detects a direction of the tilting manipulation only with the continuity signal of the adjacent two peripheral stationary contacts.

Figure 6:
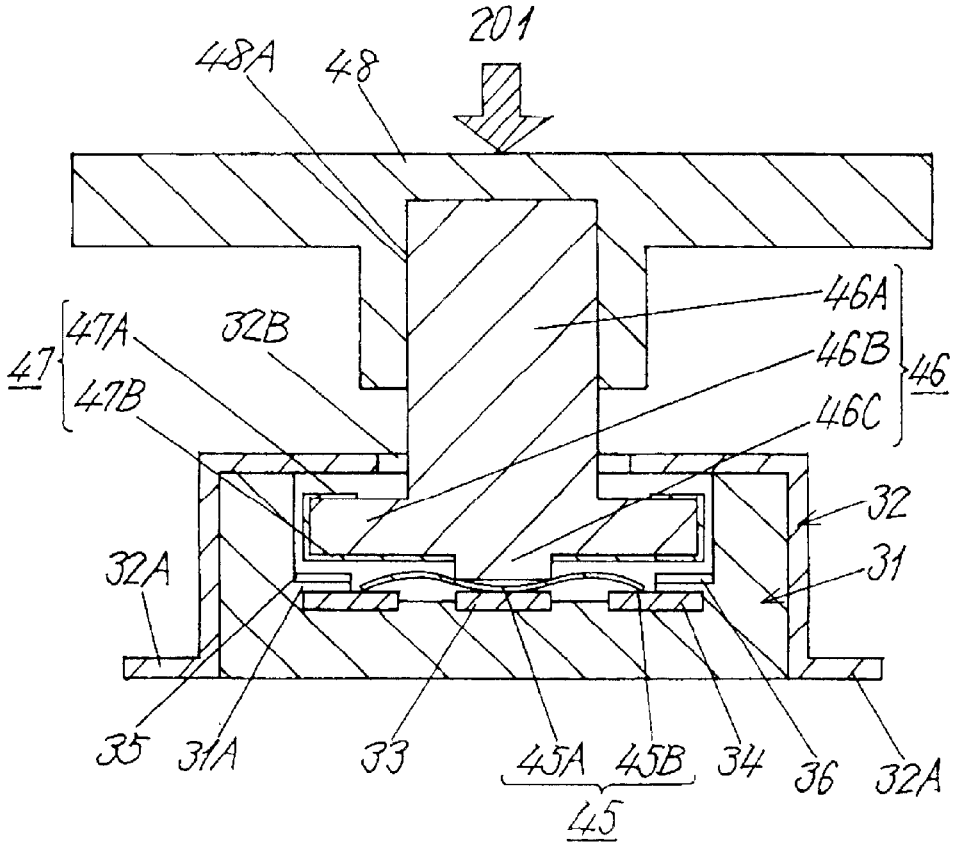
FIG. 6 is a sectional front view depicting the same multi-directional operating switch with the manipulation body in a position being depressed vertically downward.

Next, when a vertically downward depressing force is applied on the upper surface in a center of the manipulation knob 48, i.e. the shaft 46A of the manipulation body 46, as shown by an arrow in a sectional front view of FIG. 6, the manipulation body 46 moves vertically downward. This causes the projection 46C on the lower surface of the flange portion 46B to depress and deform the dome-like circular movable contact 45 downward, thereby yielding a tactile response, while also renders the underside surface of the top center portion 45A of the dome-like circular movable contact 45 to be in contact with the central stationary contact 33, and establishes an electrical continuity between the central stationary contact 33 and the outer stationary contact 34 via the dome-like circular movable contact 45. This creates a closed circuit between a terminal 39 for external connection extended from the central stationary contact 33, and another terminal 40 also for external connection extended from the outer stationary contact 34.

An erroneous contact is prevented reliably between the cover 32 and the peripheral stationary contacts 35–38 as well as among the peripheral stationary contacts 35–38, because the upper conductive portion 47A of the flange 46B moves away from the lower surface of the cover 32.

When the depressing force is removed from the manipulation knob 48, the dome-like circular movable contact 45 restores its original shape by the restoring force of its own, and the manipulation body 46 is pushed back to the normal state shown in FIG. 1.

As described above, since the multi-directional operating switch of this exemplary embodiment transmits the predetermined signals according to the tilting manipulation and the depressing manipulation, it can perform readily in an electronic apparatus equipped with this switch, such functions as, for example, moving a cursor or the like displayed in a display window of the electronic apparatus with a signal produced by the tilting manipulation for selecting a predetermined item, and entering the selected item with a signal produced by the depressing manipulation.

Furthermore, this multi directional operating switch has a structure to obtain the tactile response only by the single dome-like circular movable contact 45 disposed in the case 31, when turning on the adjacent two peripheral stationary contacts by tilting the shaft 46A of the manipulation body 46, and when producing a continuity between the central stationary contact 33 and the outer stationary contact 34 by depressing the shaft 46A of the manipulation body 46 vertically downward. Accordingly, this structure can reduce a number of constituent components, and realizes a smaller and thinner multi-directional operating switch with low cost that is capable of making a reliable and stable switching with a feeling of superior manipulation and operability.

Although what has been described above is an example wherein the shaft 46A is tiltable in four directions corresponding to respective sides of the flange 46B of square shape, this is not restrictive. Four corners of the flange 46B and the corresponding contact plate 47 may be beveled smoothly in order that the flange 46B can be tilted toward any one of the peripheral stationary contact 35–38 disposed in the four corners, and held still at those corners. Or, an apparatus having this switch may be provided on its housing body or the like with means for guiding the shaft 46A in a tiltable manner toward those directions. If such is the case, the apparatus equipped with this switch becomes capable of detecting the tilting movement of the shaft 46A in eight directions.

In the present exemplary embodiment, although what has been described above is an example in that the eletrically conductive contact plate 47 is fixed to the flange 46B of the manipulation body 46, the contact plate can be omitted if a flange 46B made of conductive material is attached to the shaft 46A.

Furthermore, the contact plate can be omitted if the manipulation body in its entirety is formed with a conductive material, whereby the manipulation body can be made easily with low cost. In such an instance, the structure can provide a switch that includes the outer stationary contact 34 additionally in the same closed circuit including any adjacent two of the peripheral stationary contacts and the covers 32 while the manipulated body is tilted.

Figure 7:
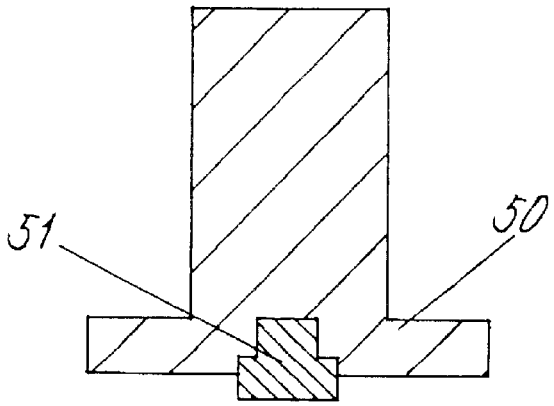
FIG. 7 is a sectional front view depicting another manipulation body, as an essential component of the same multi-directional operating switch.

If the entire manipulation body is formed with a conductive material, a rivet 51 or the like made of an insulation material may be attached to the lower end of a flange 50 made of an electrically conductive material, as shown in FIG. 7, in order to maintain an isolated condition of a switching circuit consisting of the peripheral stationary contacts and the cover from another switching circuit consisting of the central stationary contact and the outer stationary contact. This structure realizes manufacturing of a switch providing a desired feeling of manipulation easily by changing only a shape of the rivet 51, without requiring an alteration of the other components.

Moreover, although what has been described above is the switch having the flange of the manipulation body and the opening of the case in generally square shape, they may be formed into a rectangular shape in order to obtain readily a multi-direction operating switch that differentiates the tilting angle between directions orthogonal to each other.

Furthermore, the multi-directional operating switch of the present exemplary embodiment is an example wherein the peripheral stationary contacts are disposed at each corner of the generally square opening in the case. However, this multi-directional operating switch can perform the same function even if the peripheral stationary contacts are disposed at generally center of each side of the generally square opening in the case.

Second exemplary embodiment

Figure 8:
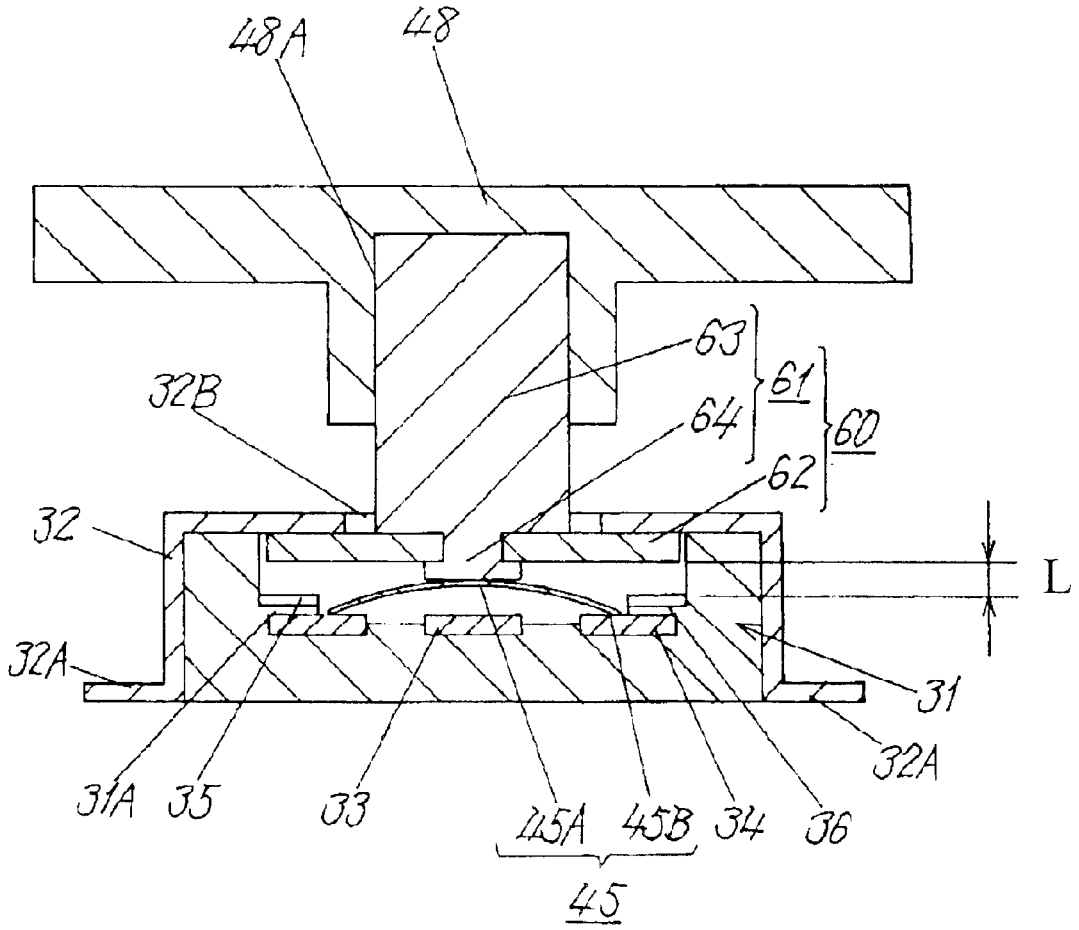
FIG. 8 is a sectional front view depicting a multi-directional operating switch of a second exemplary embodiment of the present invention.

A multi-directional operating switch of the present exemplary embodiment differs from that of the first exemplary embodiment in respect of a structure of a manipulation body 60, as shown in a sectional front view of FIG. 8.

The manipulation body 60 is constructed of an electrically conductive flange 62 of a square shape composed of a resilient metal plate attached to a lower end position of a shaft body 61 made of a rigid insulating material. An upper portion of this shaft body 61 serves as a shaft 63, and a lower end portion of the shaft body 61 protruding below the flange 62 as a projection 64.

The manipulation body 60 is disposed in a manner that the projection 64 on a lower surface of the flange 62 rests in contact with a top center portion 45A of the dome-like circular movable contact 45, so as to receive a thrusting force of the dome-like circular movable contact 45 in an upward direction, in the like manner as in the case of the first exemplary embodiment. The flange 62 is housed in a case 31 in such a manner that an upper surface of the flange 62 maintains in contact with a lower surface of the cover 32 by the thrusting force, and the shaft 63 protrudes upwardly from a central through hole 32B in the cover 32.

In other words, this manipulation body 60 is also capable of being manipulated for a vertical movement as well as a tilting movement of the shaft 63 while restricted from turning with respect to the case 31, because of the flange 62 of square shape, as in the case of the first exemplary embodiment.

Description of other constituent components will be omitted, as they are identical to those of the first exemplary embodiment.

Figure 9:
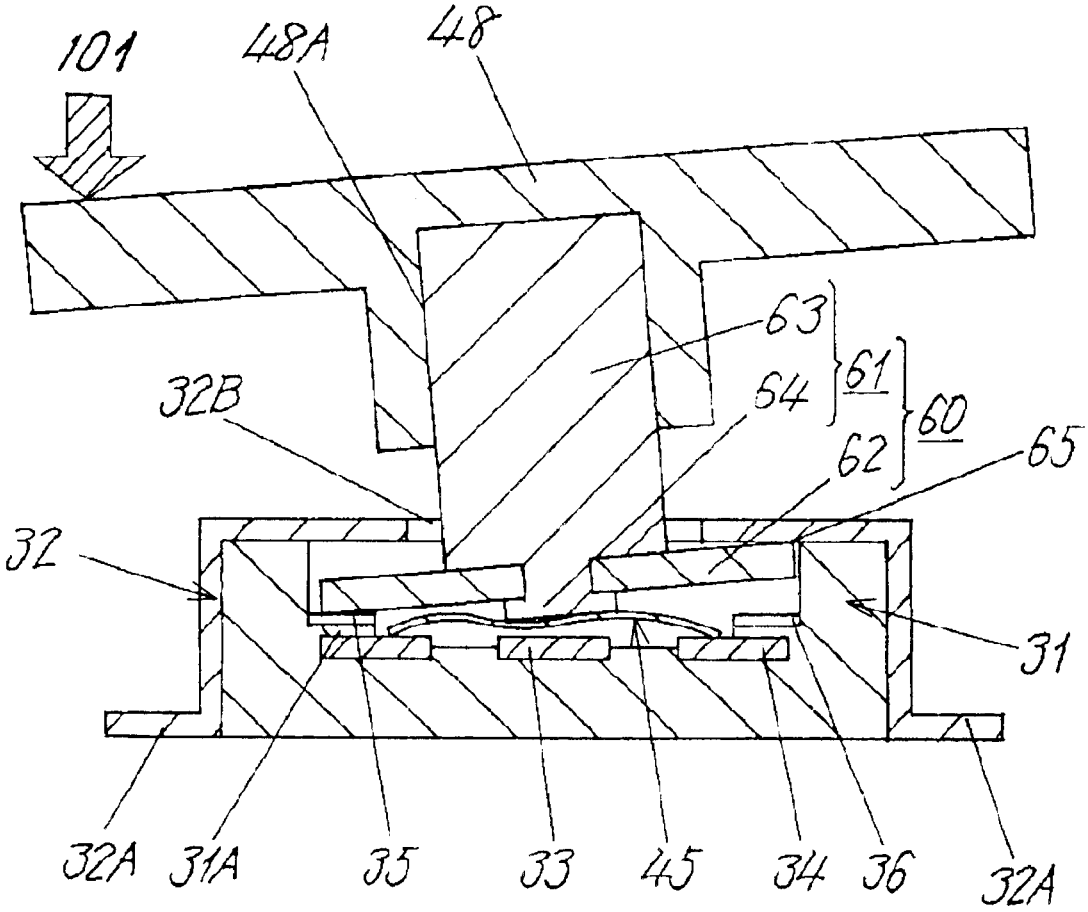
FIG. 9 is a sectional front view depicting the same multi-directional operating switch in a state where a flange is in contact with a peripheral stationary contact during a tilting manipulation.

An operation of the multi-directional operating switch as constructed above will be described next. First, when a manipulation knob 48 attached to an upper part of the shaft 63 is depressed as shown by an arrow 101 in FIG. 9 at a position corresponding to a midpoint between any adjacent two of the peripheral stationary contacts, 35 and 37 for instance, disposed on a bottom surface of the case 31, as shown in FIG. 9, the manipulation body 60 tilts, with an upper edge 65 of the flange 62, opposite to the position where the depressing force is applied, serving as a fulcrum. This causes the projection 64, an integral part of the shaft 63, to depress and deform the dome-like circular movable contact 45 downward, thereby yielding a tactile response, while also renders the lower surface of the electrically conductive flange 62 to contact with the peripheral stationary contacts 35 and 37 at the same time.

This establishes a state of electrical continuity among the peripheral stationary contacts 35 and 37 and the cover 32 through the electrically conductive flange 62, i.e. a closed circuit between predetermined peripheral switch contacts, thereby a signal is transmitted through terminals 41, 43 and 32A for external connection.

The multi-directional operating switch of this exemplary embodiment is provided with a space of a predetermined dimension (denoted by "L" in FIG. 8) between the lower surface of the electrically conductive flange 62 and upper surfaces of the peripheral stationary contacts 35–38, in order for the electrically conductive flange 62 to make contact with the peripheral stationary contacts 35 and 37 before the dome-like circular movable contact 45 comes into contact with the central stationary contact 33, after the dome-like circular movable contact 45 yields a tactile response by being deformed downward during the tilting manipulation.

Figure 10:
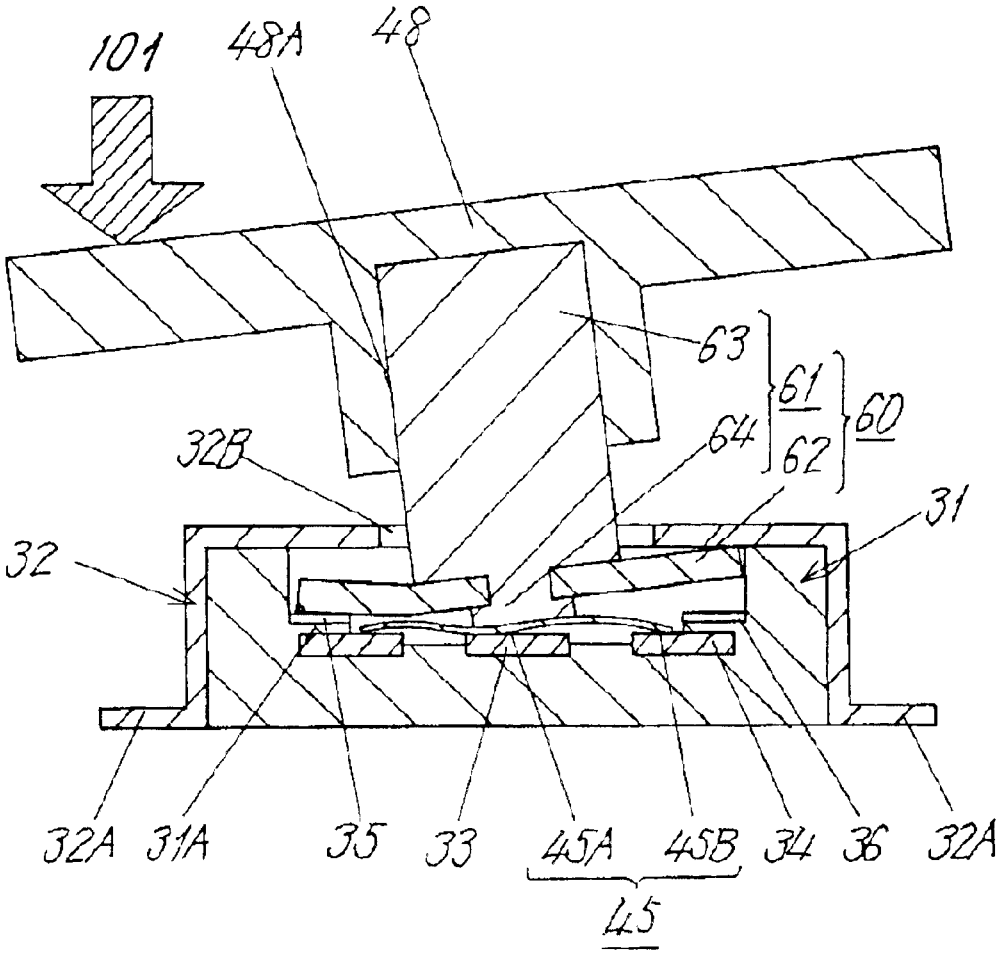
FIG. 10 is a sectional front view depicting the same multi-directional operating switch in a state where a shaft of a manipulation body is tilted to a full extent in the tilting manipulation.

When the tilting force is increased thereafter, the dome-like circular movable contact 45 is further depressed downward, as the flange 62 deforms, as shown in FIG. 10. Consequently, an underside surface of the dome-like circular movable contact 45 comes into contact with the central stationary contact 33, to establish a state of electrical continuity between the central stationary contact 33 and the outer stationary contact 34.

When the depressing force applied on the manipulation knob 48 is subsequently removed, the manipulation body 60 is pushed upward due to a resilient restoring forces of the flange 62 and the dome-like circular movable contact 45. The lower surface of the flange 62 separates from the peripheral stationary contacts 35 and 37, and the shaft 63 resumes a normal state, that is an upright neutral position, shown in FIG. 8.

When the manipulation knob 48 is depressed in the like manner at another position corresponding to a midpoint between any adjacent two of the peripheral stationary contacts, the manipulation body 60 tilts toward the respective direction, thereby making the corresponding peripheral switch contacts into an ON state. Accordingly, the switch is able to deliver signals externally through these switch contacts, and a microcomputer is able to determine a direction of the tilting manipulation after a predetermined processing of the signals, in the same way as the first exemplary embodiment.

When a vertically downward depressing force is applied on the upper surface in a center of the manipulation knob 48, i.e. the shaft 63 of the manipulation body 60, in the same manner as in the case of the first exemplary embodiment, the projection 64 depresses and deforms the dome-like circular movable contact 45 downward, as the manipulation body 60 shift downwardly, thereby yielding a tactile response, while also rendering the dome-like circular movable contact 45 to contact with the central stationary contact 33. This transmits a signal through a closed circuit between the central stationary contact 33 and the outer stationary contact 34. When the depressing force is removed, the dome-like circular movable contact 45 restores its original shape by the restoring force of its own, and pushes the manipulation body 60 back into the normal state shown in FIG. 8.

As described above, the multi-directional operating switch of this exemplary embodiment is capable of being operated for electrically making and breaking the central stationary contact 33 and the outer stationary contact 34 through the dome-like circular movable contact 45 after making any combination of two contacts among the peripheral stationary contacts 35–38 into an ON state with a tilting manipulation of the shaft 63, in addition to the switching functions provided by the first exemplary embodiment. Therefore, this multi-directional operating switch is adaptable for such an application, wherein a cursor or the like shown in a display unit in an apparatus having this switch is moved to a predetermined direction at a first speed using a switching signal obtained through the peripheral stationary contacts 35–38 by a tilting manipulation, and the moving speed shifted to an even faster second speed with another switching signal through the central stationary contact 33 and the outer stationary contact 34 by depressing the shaft 63 further into the same tilting direction.

In addition, when the switch is used in a two step operation in a manner as described above, a difference in time of electrical continuity between the signal transferred from the peripheral stationary contacts 35–38 and the other signal transferred from the center stationary contact 33 and the outer stationary contact 34 can be detected with a microcomputer (not shown). Accordingly, the cursor or the like may be scrolled at a speed corresponding to a tilting speed, force, etc. applied to the shaft 63, as they are calculated from the detected results.

Although what has been described above is an example wherein the shaft 63 of the manipulation body 60, when tilted, is capable of turning any adjacent two of the peripheral stationary contacts into a state of continuity after making the dome-like circular movable contact 45 to yield a tactile response by being deformed, followed thereafter by causing the center stationary contact 33 and the outer stationary contact 34 into the state of continuity. However, the switch may be altered into such an operational order that a tilting manipulation of the shaft 63 connects the electrically conductive flange 62 with a predetermined adjacent two of the peripheral stationary contacts, making them first into the state of continuity, and a further tilting force given thereafter to the shaft 63 depresses the dome-like circular movable contact 45 downward by deforming the flange 62, making the center stationary contact 33 and the outer stationary contact 34 into the state of continuity while deforming the dome-like circular movable contact 45 down to yield the tactile response.

Arranging the switch to make the foregoing operation can produce the tactile response in the tilting manipulation of the shaft 63 only after the peripheral switch contacts turns into the ON state. However, an operator can get a feel of clicking while making a manipulation of the peripheral switch contacts, since a moment whereat the peripheral switch contacts turn into the ON state and another moment of yielding the tactile response are very close to each other in the actual use.

Even with the multi-directional operating switch constructed as above, the operator can conform a positive validity of his manipulation with the feel of a click when making a tilting manipulation, if the microcomputer (not shown) employed for determining the tilting direction is arranged to carry out a process in such a way that it determines a signal from the peripheral switch contacts as being a valid one, only when both of the signal from the peripheral switch contacts and a signal from the center stationary contact 33 and the outer stationary contact 34 are delivered within a predetermined period of time.

In addition, the multi-directional operating switch of this exemplary embodiment provides an effect of avoiding a damage to the contacts, etc. since the flange 62 is capable of absorbing an excessive manipulation force applied to the shaft 63, because the flange 62 is constructed of a resilient body.

Third exemplary embodiment

Figure 11:
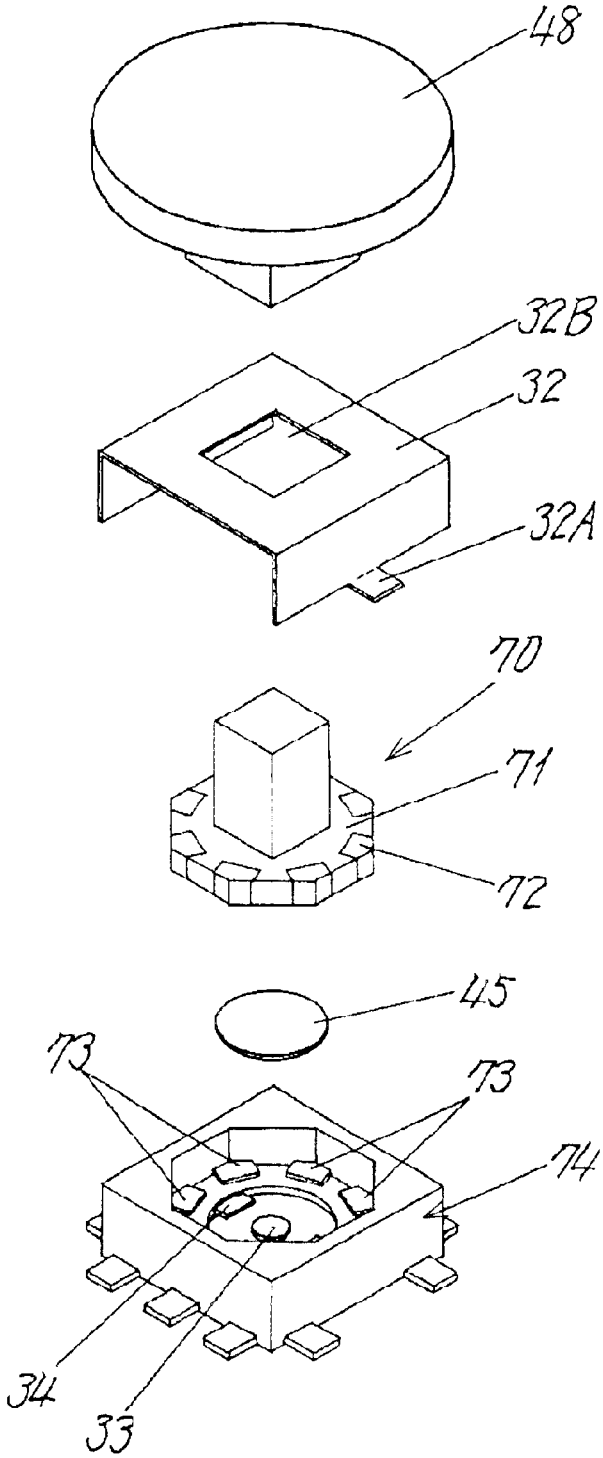
FIG. 11 is an exploded perspective view depicting a multi-directional operating switch of a third exemplary embodiment of the present invention.

A multi-directional operating switch of the present exemplary embodiment employs an opening of a case and a flange of a manipulation body having a shape as shown in an exploded perspective view of FIG. 11, which are different as compared to that of the above described first exemplary embodiment.

In other words, the flange 71 of the manipulation body 70 has an octagonal shape in the multi-directional operating switch of this exemplary embodiment, as shown in the figure. A contact plate 72 made of an electrically conductive material attached to the flange 71 in such a manner as to cover an entire lower surface, except for a lower projection (not shown) provided on a lower surface in a center of the flange 71, is fixed to an upper surface of the flange 71, after it is bent upwardly along side edges, so as to cover corners of the flange 71. Accordingly, the upper surface and the lower surface of the flange 71 are conductively connected with this contact plate 72.

An outsert molding method may be used as means of fixing the contact plate 72 to the flange 71, besides caulking.

The flange 71 is housed in the case 74 having a top opening in the similar shape of octagon in plan view in a size slightly larger than the flange 71. The case 74 is provided with a peripheral stationary contact 73 on a bottom surface at each corner of the opening. A terminal for external connection protrudes outwardly from each of the peripheral stationary contacts 73. Further description will be omitted, since a manner in which the flange 71 is housed and other constituent components are identical to those of the first exemplary embodiment.

Description pertaining to an operation of the switch will also be omitted, as it operates in the same manner as the first exemplary embodiment. Since this multi-directional operating switch is provided with a combination of the flange 71 and the opening of the case 74, both having the octagonal shape, and eight peripheral stationary contacts 73 positioned on the bottom surface at each corner of the opening in the case 74 at an equal distance and an equal angle, it is adaptable to a tilting manipulation in eight directions or sixteen directions.

A multi-directional operating switch tiltable to a desired number of directions can be obtained by arranging a combination of the flange of the manipulation body and the opening of the case in a shape of polygon such as a pentagon, a hexagon, and the like according to the desired number of tilting directions, and disposing the peripheral stationary contacts on the bottom surface at each corner of the opening.

Fourth exemplary embodiment

Figure 12:
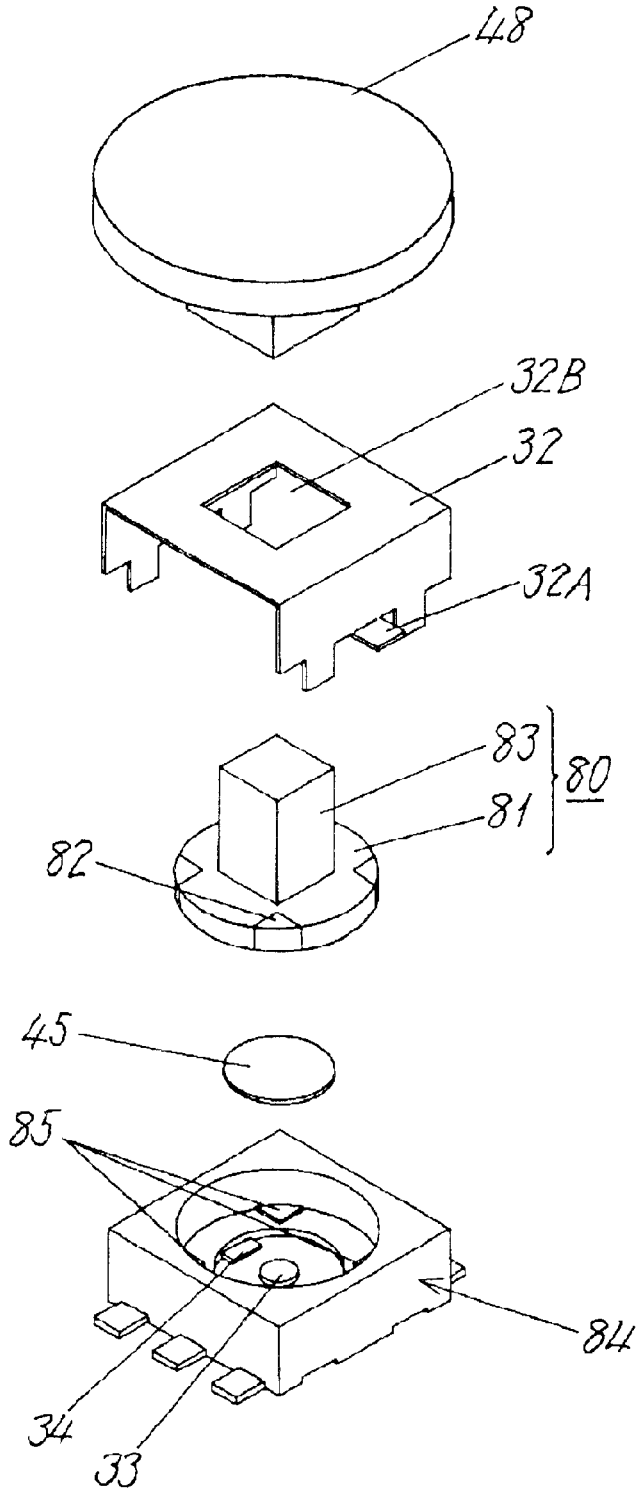
FIG. 12 is an exploded perspective view depicting a multi-directional operating switch of a fourth exemplary embodiment of the present invention.
Figure 13:
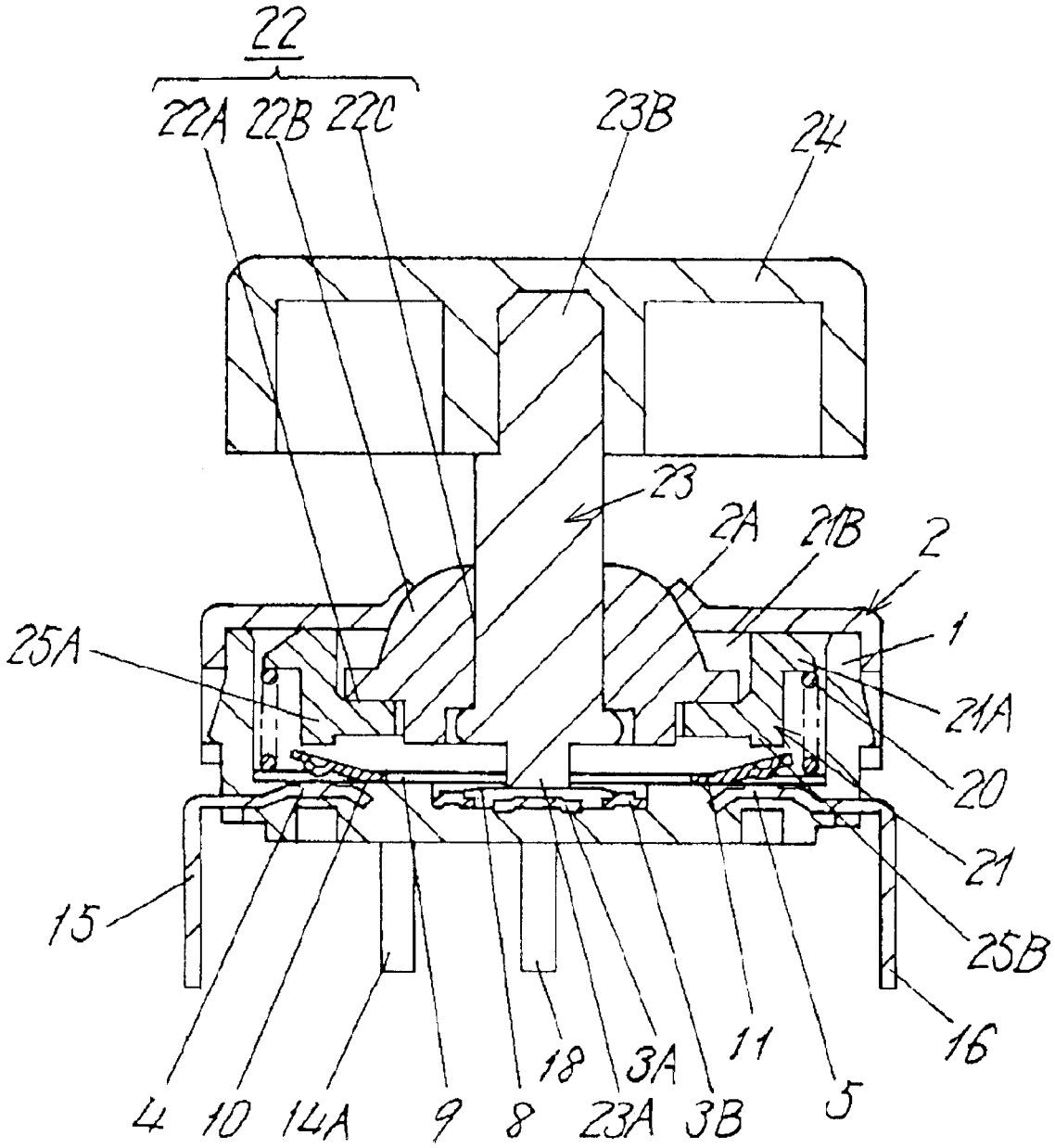
FIG. 13 PRIOR ART
FIG. 13 is a sectional front view depicting a multi-directional operating switch of the prior art.
Figure 14:
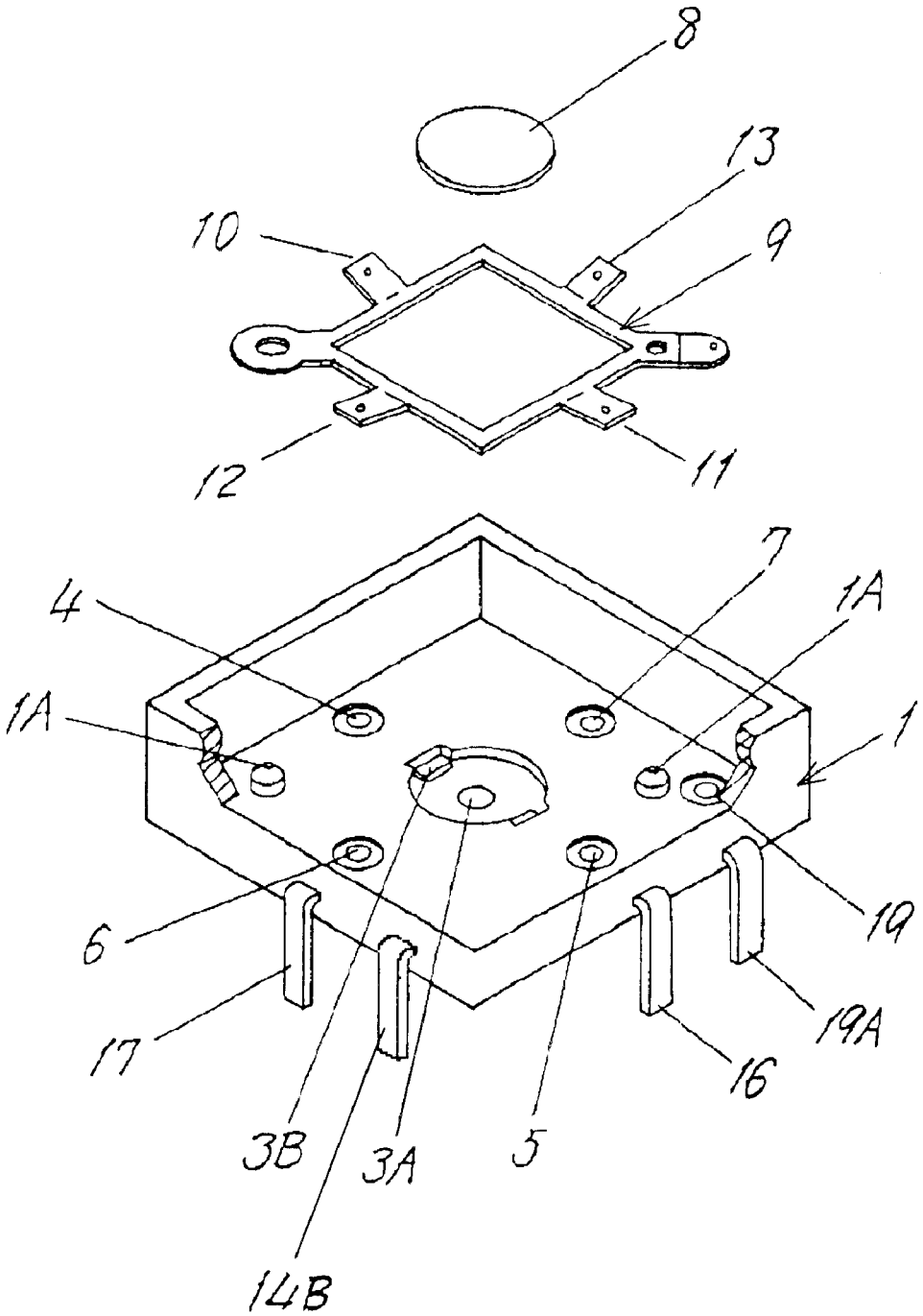
FIG. 14 PRIOR ART
FIG. 14 is an exploded perspective view depicting the same multi-directional operating switch with a case cut away partially.
Figure 15:
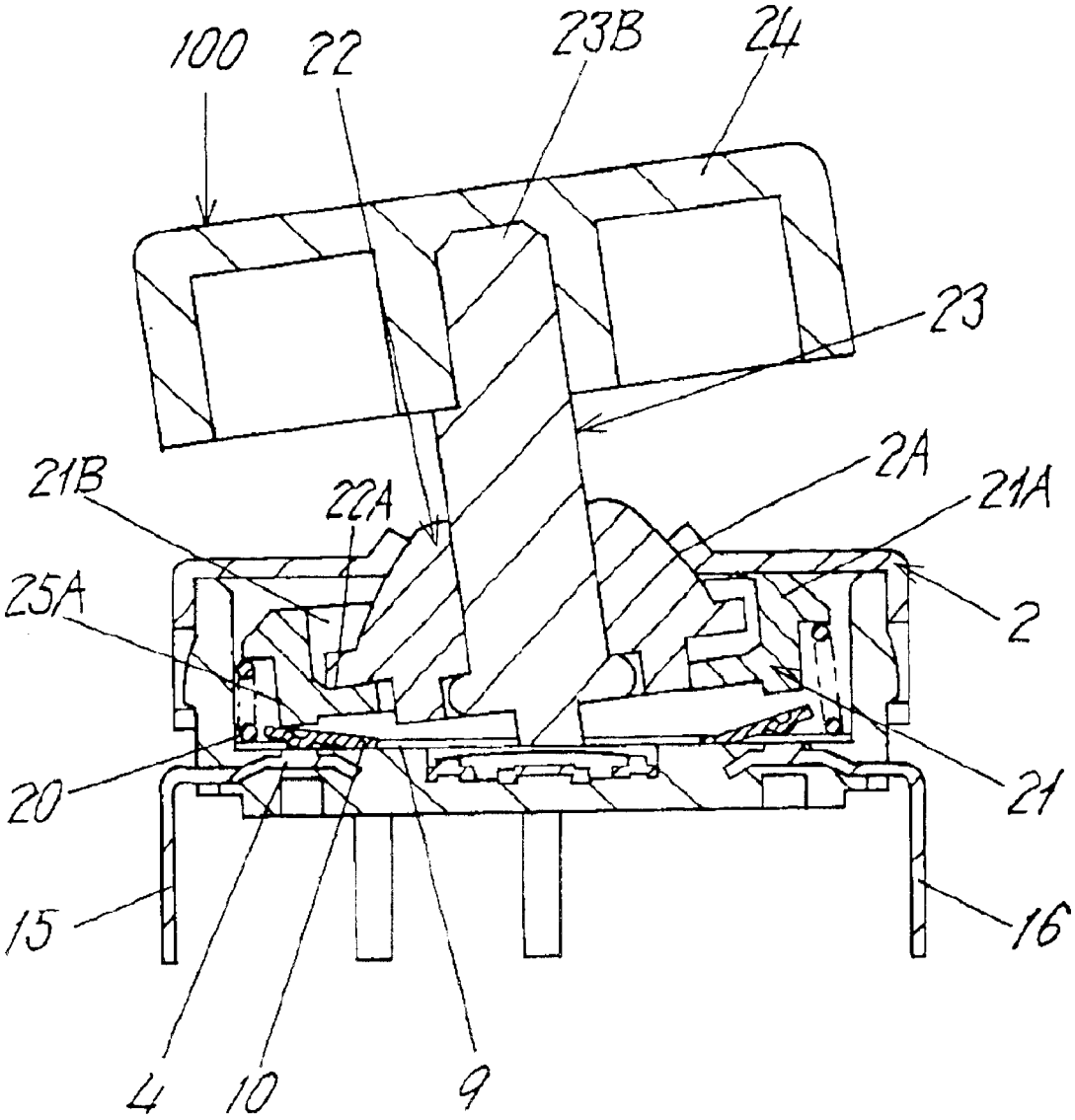
FIG. 15 PRIOR ART
FIG. 15 is a sectional front view depicting the same multi-directional operating switch with a manipulation body in a tilted position.
Figure 16:
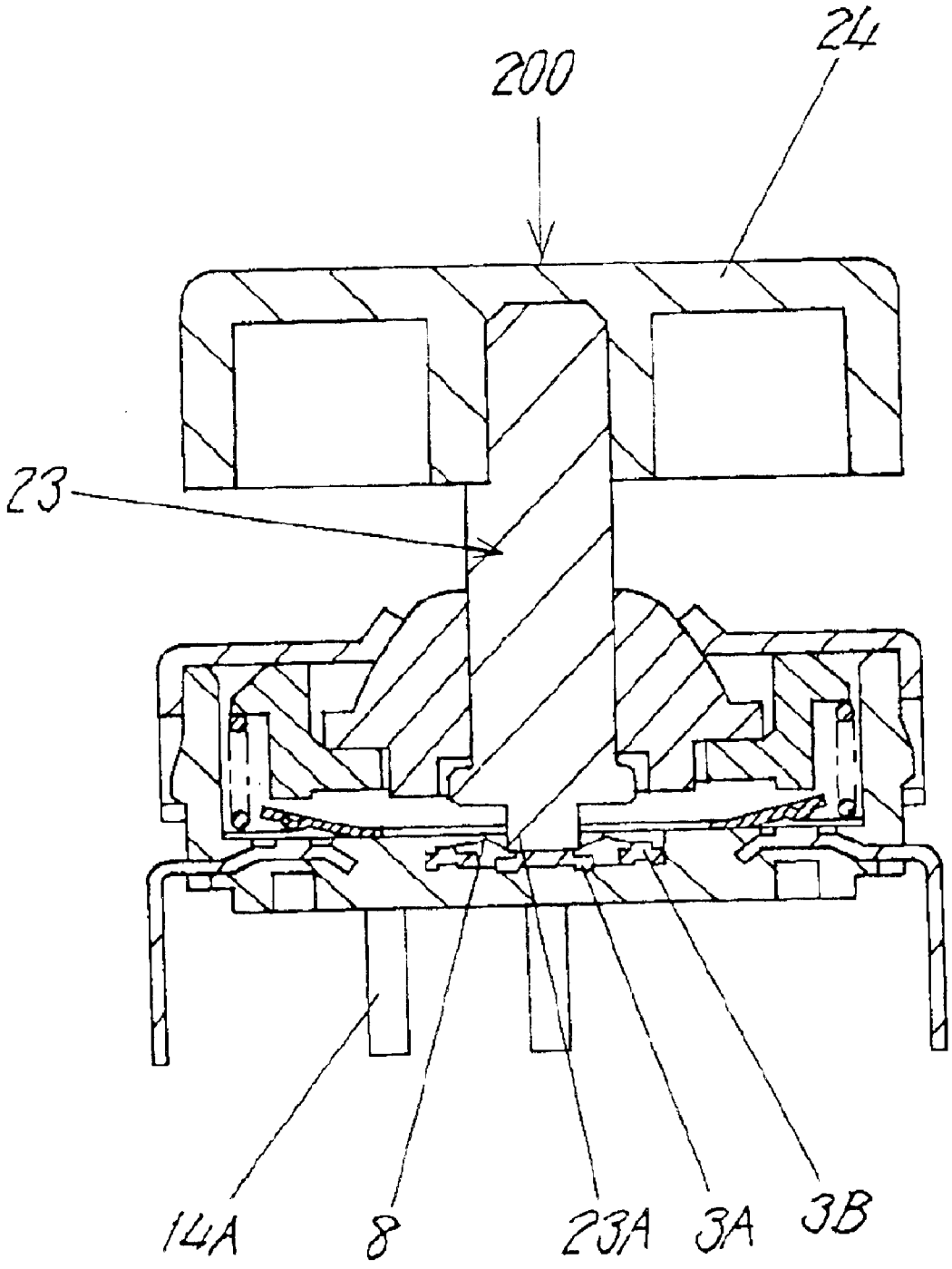
FIG. 16 PRIOR ART
FIG. 16 is a sectional front view depicting the same multi-directional operating switch with the manipulation body in a position depressed vertically downward.

A multi-directional operating switch of the present exemplary embodiment employs a circular shape for an opening of a case and a flange of a manipulation body as shown in an exploded perspective view of FIG. 12, as compared to that of the above described first and third exemplary embodiments.

A contact plate 82 made of an electrically conductive material is attached to the flange 81 having a circular shape of the manipulation body 80 by caulking, outsert molding method, or the like, in such a manner as to make an upper surface and a lower surface of the flange electrically conductive as shown in the same figure, in the like way as in the case of the first and third exemplary embodiments. Description of further details will therefore be omitted.

Moreover, this flange 81 of the manipulation body 80 is housed in a circular opening in the case 84. Peripheral stationary contacts 85 are disposed on a bottom surface of the opening in the case 84 in a manner to correspond with directions of corners of a shaft 83 having a quadrangular prism shape of the manipulation body 80, at an equal distance and an equal angle in the four directions relative to a center of the case 84. Terminals for external connection protrude outwardly from the case 84.

The shaft 83 of the quadrangular prism shape inserted in a square-shaped central through hole 32B in a cover 32 attached to the case 84 forms rotation restraining means for the manipulation body 80.

Further description will be omitted, since a manner in which the flange 81 is housed in the opening of the case 84 and other constituent components are identical to those of the first exemplary embodiment.

Description as to how the switch operates is also omitted, as it is the same as in the case of the first exemplary embodiment. The multi-directional operating switch of the present exemplary embodiment is able to prevent the manipulation body 80 from rotating within the case 84 during a manipulation by the rotation restraining means.

The turn restraining means may be constituted of other combination such as those of a polygonal shape or an elliptical shape, besides the foregoing structure. In a switch provided with a combination of those of polygonal shape, in particular, such as octagon having many corners, a manipulation body becomes movable sideways for shifting a tilting direction in a manner that a tip of the shaft swings along a circle while it is kept tilted. The manipulation body can be thus operable smoothly to switch the peripheral stationary contacts consecutively in a predetermined circular direction.

Fifth exemplary embodiment

The present exemplary embodiment relates to a multi-directional operating apparatus using a multi-directional operating switch of this invention. A mobile communications apparatus will be described as an example. In the mobile communications apparatus such as a cellular phone, a radio pager, and the like, equipped with a multi-directional operating switch of this invention, for instance, an operator performs a tilting manipulation of a shaft to move a cursor, scroll and search a menu, characters, etc., shown in a display window such as a liquid crystal screen, makes a pushing manipulation of the shaft to enter the menu, and executes the selected menu, i.e. transmission of a signal, by making another pushing manipulation.

Sixth exemplary embodiment

The present exemplary embodiment relates to a multi-directional operating apparatus using a multi-directional operating switch of this invention. Various kinds of remote controller and audio equipment are examples of an apparatus described below. In a remote controller and audio equipment equipped with a multi-directional operating switch of this invention, an operator can turn a power supply on and off, or select playback and stop one after another by repeating a pushing manipulation of a shaft. A prearranged command can be executed by a tilting manipulation of the shaft, if commands for selection of station or music, high and low of sound volume, fast-forwarding and rewinding, and so on are combined appropriately and allocated to each of a forward-to-backward direction and a right-to-left direction of tilting manipulation of the shaft.

In addition, the allocated commands can be switched by making a pushing a manipulation of the shaft.

Seventh exemplary embodiment

The present exemplary embodiment relates to a multi-directional operating apparatus using a multi-directional operating switch of this invention. A game machine and a car navigation system will be taken as an example. In a game machine or a car navigation system equipped with a multi-directional operating switch of this invention, an operator performs a tilting manipulation of a shaft to move a character or a map in a display window according to a certain manner of tilting the shaft, and executes a prearranged command such as changing a magnification of the map, jumping the character, and so on by a pushing manipulation of the shaft.

Eighth exemplary embodiment

The present exemplary embodiment relates to a multi-directional operating apparatus using a multi-directional operating switch of this invention, and an electronic camera will be taken as an example. In an electronic camera equipped with a multi-directional operating switch of this invention, an operator performs a tilting manipulation of a shaft to select a shutter speed, a lens opening, and so on, and enters the selected values by a pushing manipulation of the shaft. Furthermore, the operator can set a position of an object to be focused in a view finder by making another tilting manipulation of the shaft, bring the focus on the subject by pushing the shaft, and release a shutter by pushing the shaft again within a predetermined period of time.

Ninth exemplary embodiment

The present exemplary embodiment relates to a multi-directional operating apparatus using a multi-directional operating switch of this invention, and a computer will be taken as an example. In a computer equipped with a multi-directional operating switch of this invention, an operator can enter and execute a menu by making a pushing manipulation, after moving a cursor in a display window and selecting the menu by a tilting manipulation of a shaft.

As has been described, the present invention can provide a multi-directional operating switch having such advantageous features as using a less number of constituent components, smaller outer dimensions and thickness, a lower cost, as well as performing a reliable and steady switching operation with a positive tactile response even when making the switching operation by tilting a manipulation body sideways.

In addition, a multi-directional operating apparatus using the multi-directional operating switch of this invention realizes an effect of achieving congregation and simplification of a variety of operating functions at the same time with reduction in size, thickness and weight.

What is claimed is:

1. A multi-directional operating switch comprising:

a case having an opening on top, provided on a bottom surface thereof with a central contact, an outer contact disposed away from said central contact, and a plurality of peripheral contacts;

a dome-like circular movable contact having a central portion situated above said central contact, and a lower peripheral rim of said dome-like circular movable contact rests in contact with said outer contact;

an electrically conductive cover having a through hole concentric to said dome-like circular movable contact;

a manipulation body including a shaft protruding through the through hole in said cover, a flange formed integrally with or fixed to a lower portion of said shaft, provided with an upper surface and a lower surface thereof for conductively connecting therebetween, and a projection provided on said shaft;

wherein said flange is restricted from turning and said shaft is tiltable as well as vertically movable, and at least a periphery of said flange stays in contact with an underside surface of said cover with a thrusting force in an upward direction by said dome-like circular movable contact, and said projection on said flange depresses and deforms said dome-like circular movable contact, thereby establishing an electrical continuity between said central contact and said outer contact, when said shaft is pushed downward, and said flange establishes an electrical continuity between said peripheral contacts and said cover when said shaft of said manipulation body is tilted.

2. The multi-directional operating switch according to claim 1, wherein the opening in said case has generally square shape, and said flange is formed in a shape generally similar to said opening.

3. The multi-directional operating switch according to claim 2, wherein said plurality of peripheral contacts are disposed on the bottom surface at each corner of the opening of said case.

4. The multi-directional operating switch according to claim 1, wherein the opening in said case and said flange of said manipulation body are generally rectangular in similar shape.

5. The multi-directional operating switch according to claim 1, wherein the opening in said case and said flange of said manipulation body are one of generally pentagonal, hexagonal and octagonal of similar shape.

6. The multi-directional operating switch according to claim 1, wherein the opening in said case is circular in shape, said plurality of peripheral contacts are disposed at equal distance and equal angular direction relative to a center of said case, and said flange of said manipulation body is formed into a circular shape of a size smaller than said opening.

7. The multi-directional operating switch according to claim 6, further comprising turn restricting means comprised of a through hole of non-circular shape in said cover and a non-circular shaft of said manipulation body.

8. The multi-directional operating switch according to claim 1, wherein said manipulation body is composed of an electrical conductive material.

9. The multi-directional operating switch according to claim 8, wherein said projection is provided on a lower end of said manipulation body and is composed of an insulation material.

10. The multi-directional operating switch according to claim 1, wherein said shaft and said projection are integrally composed of a rigid insulation material.

11. The multi-directional operating switch according to claim 10, wherein said flange is made of an electrically conductive material having resiliency, whereby establishing an electrical continuity first between said peripheral contacts and said cover, and another electrical continuity thereafter between said central contact and said outer contact, as said projection under said flange subsequently depresses said dome-like circular movable contact after said flange of said manipulation body distorts resiliently, when said shaft is tilted.

12. A multi-directional operating apparatus including a multi-directional operating switch according to claim 1, wherein:

said apparatus detects a closed circuit between adjacent two of said plurality of peripheral contacts and selects an item among a plurality of items displayed when the shaft of said manipulation body of said multi-directional operating switch is tilted; and said apparatus detects a closed circuit between said central contact and said outer contact and determines said selected item when the shaft is depressed vertically downward.

13. The multi-directional operating apparatus according to claim 12, wherein said apparatus detects a plurality of sequential continuity signals transmitted from said central contact and said outer contact produced when the shaft vertically is depressed continuously for a plurality of times within a predetermined period of time, and executes a plurality of predetermined commands corresponding to the signals in a sequential order.

14. The multi-directional operating apparatus according to claim 12, wherein said apparatus executes two functions allocated in advance to each of tilting directions of the shaft, when said shaft is tilted in directions opposite to each other with respect to a center of said shaft.

15. The multi-directional operating apparatus according to claim 14, wherein said apparatus detects a signal transmitted from said central contact and said outer contact produced by the shaft depressed vertically downward, and switches a command pre-allocated to each of tilting directions of the shaft in a predetermined order in response to the detected signal.

16. A multi-directional operating apparatus including a multi-directional operating switch according to claim 1, wherein:

said apparatus detects a closed circuit between adjacent two of said plurality of peripheral contacts, selects one of a plurality of signals allocated in advance to directions of vector, and moves an object being displayed toward a direction of vector corresponding to the selected signal when said shaft of said manipulation body of said multi-directional operating switch is tilted; and said apparatus detects a closed circuit between said central contact and said outer contact, and executes a command allocated in advance to the moved object when the shaft is depressed vertically downward.

17. The multi-directional operating apparatus according to claim 16, wherein said apparatus detects a plurality of sequential continuity signals transmitted from said central contact and said outer contact produced when the shaft vertically is depressed continuously for a plurality of times within a predetermined period of time, and executes a plurality of predetermined commands corresponding to the signals in a sequential order.

18. The multi-directional operating apparatus according to claim 16, wherein said apparatus executes two functions allocated in advance to each of tilting directions of the shaft, when said shaft is tilted in directions opposite to each other with respect to a center of said shaft.

19. The multi-directional operating apparatus according to claim 18, wherein said apparatus detects a signal transmitted from said central contact and said outer contact produced by the shaft depressed vertically downward, and switches a command pre-allocated to each of tilting directions of the shaft in a predetermined order in response to the detected signal.

20. The multi-directional operating apparatus according to claim 16, wherein said apparatus detects a signal transmitted from said central contact and said outer contact produced by the shaft depressed vertically downward, and switches a command pre-allocated to each of tilting directions of the shaft in a predetermined order in response to the detected signal.

* * * * *